US008453418B2

(12) United States Patent
Smith et al.

(10) Patent No.: US 8,453,418 B2
(45) Date of Patent: Jun. 4, 2013

(54) DOCUMENT INSERTING APPARATUS

(75) Inventors: Damon Smith, Essex (GB); David Dronsfield, Essex (GB)

(73) Assignee: Neopost Technologies, Bagneux (FR)

( * ) Notice: Subject to any disclaimer, the term of this patent is extended or adjusted under 35 U.S.C. 154(b) by 370 days.

(21) Appl. No.: 12/796,104

(22) Filed: Jun. 8, 2010

(65) Prior Publication Data

US 2010/0313530 A1 Dec. 16, 2010

(30) Foreign Application Priority Data

Jun. 12, 2009 (GB) ..... 0910146.0

(51) Int. Cl.
*B43M 3/04* (2006.01)

(52) U.S. Cl.
USPC ..... 53/381.7; 53/381.5; 53/284.3; 53/569

(58) Field of Classification Search
CPC ..... B43M 3/00; B43M 3/04; B43M 3/045
USPC ..... 53/284.3, 381.5, 387.1, 460, 569, 53/381.7; 270/58.06
IPC ..... B43M 3/00, 3/04
See application file for complete search history.

(56) References Cited

U.S. PATENT DOCUMENTS

| | | | | |
|---|---|---|---|---|
| 3,739,543 | A * | 6/1973 | Harris | 53/492 |
| 4,205,506 | A | 6/1980 | Moens et al. | |
| 5,154,404 | A | 10/1992 | Lee, Jr. et al. | |
| 5,191,751 | A * | 3/1993 | Marzullo et al. | 53/569 |
| 5,209,133 | A * | 5/1993 | Ballard | 74/89.23 |
| 5,327,705 | A * | 7/1994 | DeFigueiredo | 53/569 |
| 5,642,598 | A * | 7/1997 | Cannaverde | 53/284.3 |
| 5,740,663 | A * | 4/1998 | de Haan et al. | 53/569 |
| 5,802,808 | A * | 9/1998 | Lyga | 53/381.5 |
| 7,047,711 | B2 * | 5/2006 | Ballestrazzi et al. | 53/569 |
| 7,454,882 | B2 * | 11/2008 | Kapturowski et al. | 53/492 |
| 7,788,880 | B2 * | 9/2010 | Kern | 53/381.7 |
| 2001/0022064 | A1 * | 9/2001 | Hidding et al. | 53/460 |
| 2003/0041571 | A1 * | 3/2003 | Haller et al. | 53/569 |
| 2003/0230047 | A1 | 12/2003 | Smith, Jr. et al. | |
| 2006/0042196 | A1 * | 3/2006 | Stemmle et al. | 53/381.5 |
| 2008/0086983 | A1 * | 4/2008 | Kapturowski et al. | 53/381.5 |

FOREIGN PATENT DOCUMENTS

| | | | |
|---|---|---|---|
| EP | 1 911 602 | A2 | 4/2008 |
| GB | 2 225 763 | A | 6/1990 |
| GB | 2 276 603 | A | 10/1994 |
| WO | 02/090127 | A1 | 11/2002 |

* cited by examiner

*Primary Examiner* — Stephen F Gerrity
(74) *Attorney, Agent, or Firm* — Sughrue Mion, PLLC

(57) ABSTRACT

An apparatus for inserting a document into an envelope. The apparatus includes a mechanism for holding an envelope at an insert station; pivotally mounted fingers for opening the envelope; and a platform for guiding the document over the fingers and into the envelope. The platform is pivoted at an upstream end and upwardly spring biased so that the platform is depressed against the spring bias, by an amount dependent on the weight of the insert document moving over, so that a light insert document follows a path which subtends a steeper angle to the horizontal compared to a heavy insert document.

4 Claims, 3 Drawing Sheets

DOCUMENT INSERTING APPARATUS

The present invention relates to apparatus for inserting a document into an envelope for mailing. For example, several sheets of paper or other documents are accumulated one by one into a stack to be inserted into a single envelope for bulk mailings.

An example of a typical mailing system is the Maxi-Mailer™ manufactured by PFE International Limited. Typically a collator module is provided where incoming sheets of paper or other documents are collected together by stacking them one on top of each other to form an insert. When the insert is complete it is moved by a conveyer belt or a mechanical pusher toward an inserter station. An envelope is held at the inserter station in a fixed position and the mouth of the envelope is opened so that the insert can be pushed into the envelope. Usually the envelope is held by its flap with the address side, or window in the case of a window envelope, facing upwards.

Ideally an insert should follow a straight line when it is being pushed into an envelope, to minimise the possibility of paper jams or of an insert being bent or damaged during the insertion process. This is difficult if a variety of thicknesses of inserts is to be handled in the same apparatus, particularly at the high speeds typical of modern machines. Usually an inserter apparatus has to accommodate insert stacks from about 0.1 mm thick (e.g. a single sheet) up to about 6 mm.

EP 1 911 602 shows apparatus for opening an envelope to a varying extent dependent on the physical characteristics of the document to be inserted. This is achieved by mechanically attaching envelope insertion fingers to a collate bed and mechanically adjusting the position of the collate bed to regulate an amount that the mouth of the envelope is opened. The adjustment is made by a controller in dependence upon information in bar codes.

According to a first aspect of the present invention there is provided apparatus for inserting a document into an envelope, the apparatus comprising: means for holding an envelope at an insert station; pivotally mounted fingers for opening the envelope; and means for moving the document to be inserted along a platform, over the fingers and into the envelope; wherein the platform is upwardly biased so that the platform is automatically depressed against the bias, by an amount dependent on the weight of the insert document.

Preferably the platform is pivoted at an upstream end so that a light insert document follows a path which subtends a steeper angle to the horizontal compared to a heavy insert document.

The bias is preferably resilient and could be provided by a spring.

Thus the present invention reduces paper jams and avoids buckling thin inserts, whilst allowing a larger variety of thicknesses than is usual to be handled in the same apparatus without adjustment. It provides a relatively simple system for ensuring the appropriate path for a variety of insert documents without the need for complex mechanical adjustments.

According to a preferred embodiment of the invention transport rollers are arranged to hold the envelope flap at the insert station.

Preferably the insertion fingers are rotatably attached to a finger body and rotate by an amount dependent on the weight of the insert document passing over the fingers.

The apparatus preferably comprises a bridging piece arranged to bias upwardly the upper edge of the envelope opening.

For a better understanding of the present invention, and to show how the same may be carried into effect, reference will now be made, by way of example, to the accompanying drawings, in which.

Figure 1:
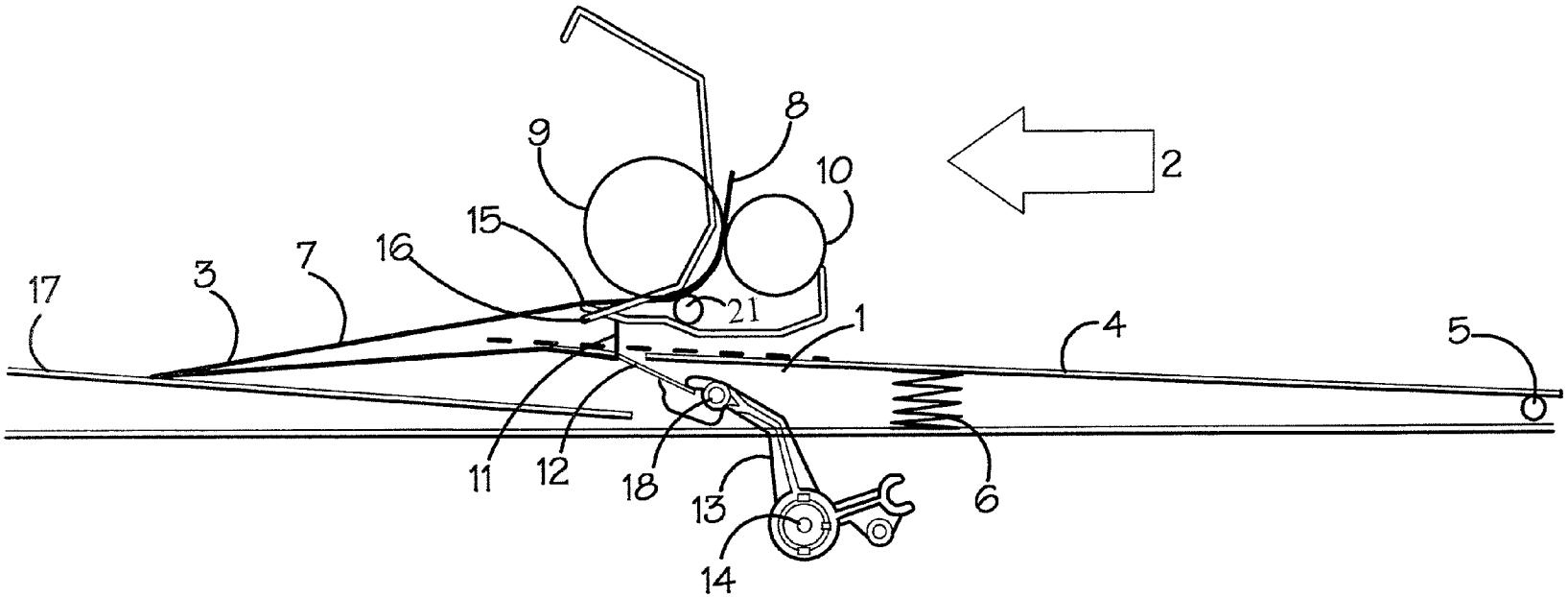
FIG. 1 is a cross section of an inserter apparatus according to the invention with a thin insert.

In FIG. 1 a thin insert 1 travels in the direction of arrow 2 to be inserted into envelope 3 which is supported on an insertion area bed 17. The insert 1 is driven across a collate pocket bed 4 which is pivoted at its upstream end about pivot 5 and has its downstream end biased in an upward direction by spring 6. The envelope 3 is, in this example, a window envelope and the window is shown at 7 facing in an upward direction. The flap 8 of the envelope is held between large transport rollers 9, 10 and a small roller 21. The mouth 11 of the envelope is opened by insertion fingers 12 which only one is shown in FIG. 1 pivotally mounted at one end of a finger body 13 at pivot 18. Finger body 13 is pivoted about pivot point 14. The centre portion of the upper edge of the envelope mouth 11 is supported by a centre bridge 15 which is a static feature and serves, in combination with a finger bridge 16, to keep the envelope open. The finger bridge 16 is actually cut away and the centre bridge 15 extends through the cut away. When the envelope is held ready for insertion the outer portions of the envelope flap are in contact with the underside of the finger bridge 16 and the outer two insertion fingers 12*a* rest against the underside of the envelope flap before they are moved into the envelope. In addition the central portion of the envelope rests on top of the centre bridge 15. The inner two insertion fingers 12*b* are in contact with the underside of the centre bridge 15 before they are moved into the envelope.

As can be seen from the figure, the insert 1 enters the envelope in a straight line guided by the lower insertion finger 12 across the threshold of the mouth, so that the leading edge of the insert 1 does not directly contact any part of the envelope until a substantial part of the insert has entered the envelope. In this way the insert 1 is less likely to buckle because it is substantially supported along a straight path. Hence paper jams are kept to a minimum.

Figure 2:
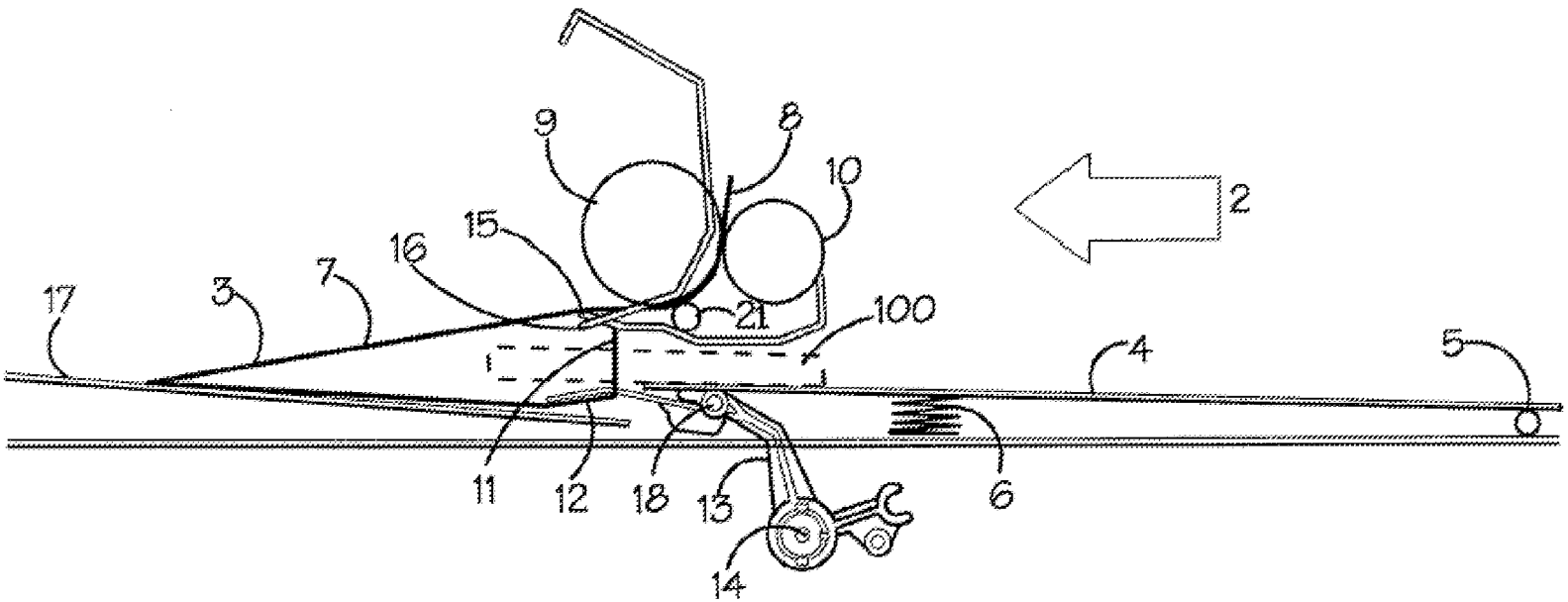
FIG. 2 is a cross section of the inserter apparatus of FIG. 1 with a thick insert.

In FIG. 2 the same apparatus is used with a thicker and heavier insert 100. Again the insert 100 travels in the direction of arrow 2 across the collate pocket bed 4 and enters the envelope 3 through its mouth 11. In this case however, the additional weight of insert 100 causes the spring 6 to be depressed, thus lowering the collate pocket bed 4 about pivot point 5. The weight of the insert also pivots the finger body 13 about pivot point 14 and moves the insertion fingers lower so as to open the mouth 11 of the envelope 3 wider. Hence insert 100 follows an insertion path which is shallower than in FIG. 1 which had a lighter insert, and is also a relatively straight path into the envelope.

Figure 3:
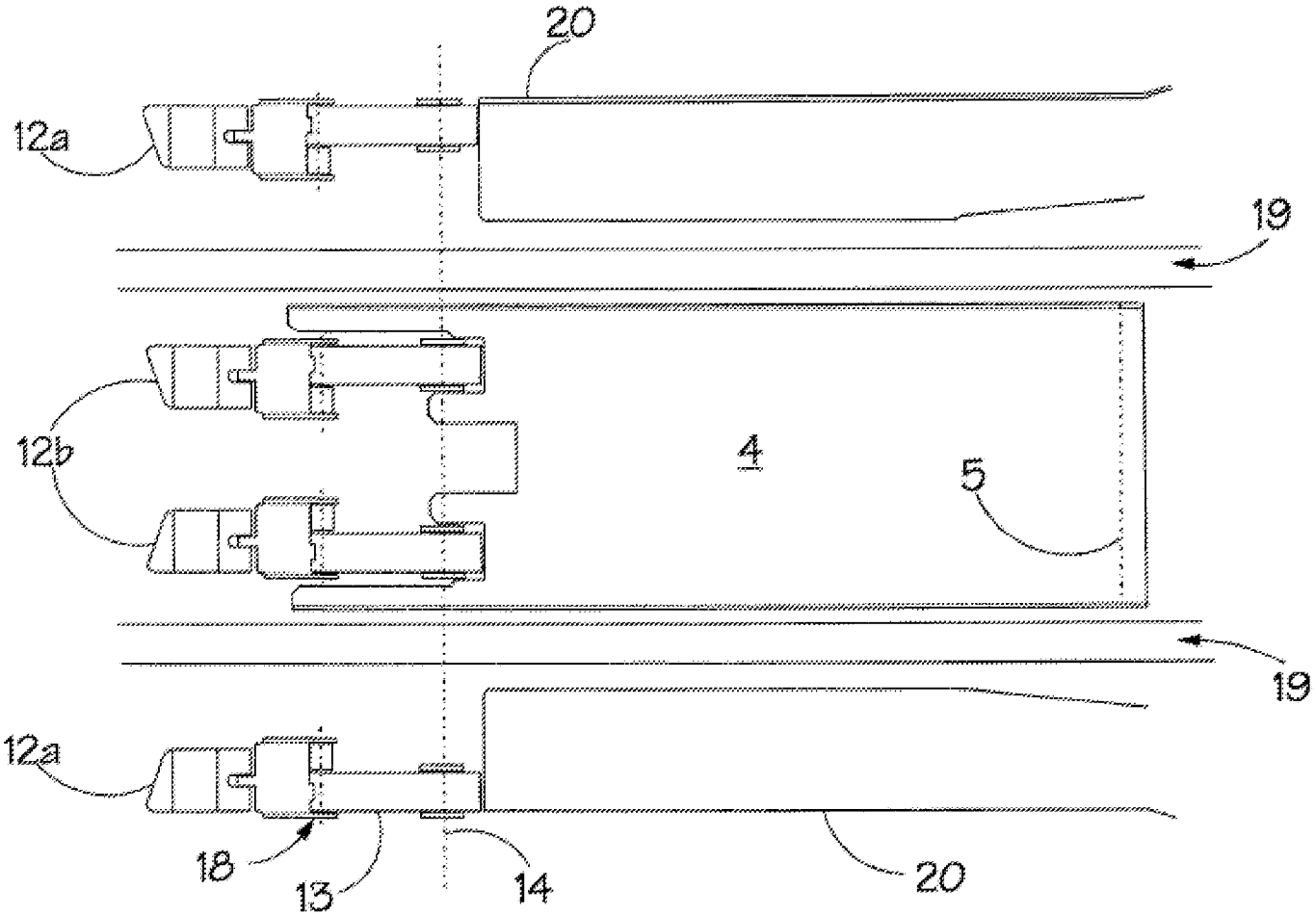
FIG. 3 is a top plan view of the inserter of the invention.

FIG. 3 illustrates the plurality of insertion fingers 12*a*, 12*b* more clearly, showing that, in this example, there are two outer fingers 12*a* and two inner fingers 12*b*. Each finger is pivoted about line 18 and each finger body is pivoted about line 14. Insert pawls (not shown) push a document from right to left in the figure. They travel in channels 19 on either side of the collate pocket bed 4. Documents are constrained laterally by side guides 20, which guide them into the envelope and are needed because the side clearance between the insert stack and the envelope is small.

The invention allows a suitable insertion path geometry to automatically be adopted for a variety of insert thickness ranges and ensures that the insert path profile is adapted to the most suitable profile for the insert concerned.

The invention claimed is:

1. An apparatus for inserting a document into an envelope, the apparatus comprising:

an envelope holder for holding an envelope at an insert station;

pivotally mounted insertion fingers for opening the envelope; and a platform for guiding the document to be inserted over the fingers and into the envelope, the platform being pivoted at an upstream end so that a light insert document follows a path which subtends a steeper angle to the horizontal compared to a heavy insert document, wherein the platform is upwardly biased by a spring so that the platform is automatically depressed against the spring by an amount dependent on the weight of the insert document on the platform.

2. An apparatus according to claim 1, comprising transport rollers for holding an envelope flap at the insert station.

3. An apparatus according to claim 1, wherein the insertion fingers are rotatably attached to a finger body and rotate about an axis by an amount dependent on the weight of the insert document passing over the fingers.

4. An apparatus according to claim 3, further comprising a bridging piece arranged to bias upwardly the upper edge of the envelope opening.

* * * * *